US009097222B2

(12) United States Patent
Cho

(10) Patent No.: US 9,097,222 B2
(45) Date of Patent: Aug. 4, 2015

(54) ACTIVE CONTROL SOUND GENERATOR

(71) Applicants: Hyundai Motor Company, Seoul (KR); Kia Motors Corporation, Seoul (KR)

(72) Inventor: Yoon Keun Cho, Daegu (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 66 days.

(21) Appl. No.: 14/089,270

(22) Filed: Nov. 25, 2013

(65) Prior Publication Data

US 2014/0165950 A1 Jun. 19, 2014

(30) Foreign Application Priority Data

Dec. 17, 2012 (KR) ..... 10-2012-0147800

(51) Int. Cl.
*F02M 35/108* (2006.01)
*F02M 35/12* (2006.01)

(52) U.S. Cl.
CPC ..... *F02M 35/1294* (2013.01); *F02M 35/1222* (2013.01)

(58) Field of Classification Search
CPC ..... F02M 35/12; F02M 35/1205; F02M 35/1222; F02M 35/125; F02M 35/1294; F02M 35/16
USPC ..... 123/184.21–184.61; 181/204
See application file for complete search history.

(56) References Cited

U.S. PATENT DOCUMENTS

| | | | | |
|---|---|---|---|---|
| 6,202,409 | B1 * | 3/2001 | Taylor | 60/312 |
| 7,188,703 | B2 * | 3/2007 | Hofmann et al. | 181/271 |
| 2008/0066999 | A1 * | 3/2008 | Kostun et al. | 181/250 |
| 2009/0236172 | A1 * | 9/2009 | Ross et al. | 181/204 |
| 2013/0139787 | A1 * | 6/2013 | Lee, II | 123/337 |
| 2013/0199487 | A1 * | 8/2013 | Bernard | 123/184.53 |

FOREIGN PATENT DOCUMENTS

JP 2010-37980 A 2/2010

* cited by examiner

*Primary Examiner* — Marguerite McMahon
(74) *Attorney, Agent, or Firm* — Morgan, Lewis & Bockius LLP

(57) ABSTRACT

An active control sound generator apparatus may include a housing disposed at an end of an intake duct in a vehicle, having an intake port at an end, and having a driving unit case thereon, a control actuator disposed at a side in the driving unit case, a valve plate disposed in the intake port and connected to a rotary shaft, wherein the valve plate selectively opens or closes the intake port, a control unit including a position sensing wheel disposed at an end of the rotary shaft of the valve plate, in the driving unit case to measure a rotation amount of the valve plate, and a driving gear assembly engaged with the valve plate and the rotary shaft, in the driving unit case, and reducing and transmitting torque of the control actuator to the rotary shaft.

7 Claims, 4 Drawing Sheets

ACTIVE CONTROL SOUND GENERATOR

CROSS-REFERENCE TO RELATED APPLICATION

The present application claims priority to Korean Patent Application No. 10-2012-0147800 filed on Dec. 17, 2012, the entire contents of which is incorporated herein for all purposes by this reference.

BACKGROUND OF THE INVENTION

1. Field of the Invention

The present invention relates to an active control sound generator. More particularly, the present invention relates to an active control sound generator that controls tone in accordance with the RPM of an engine and load conditions of a vehicle.

2. Description of Related Art

In general, as noise generated when a vehicle travels, there are various noises such as engine noise, friction noise due to rolling friction in traveling, flow noise due to air flow.

In order to solve such a problem, it is possible to prevent deterioration of comport for passengers in vehicles by mounting an expensive soundproofing material in the vehicles.

However, since most noises of vehicles are flow noise and noise such as booming sound at a specific bandwidth due to pulsation generated by an engine etc., it is very difficult to completely block the noises in the vehicles.

A resonator was mounted in vehicles in the related art to remove the booming noise due to pulsation, but the resonator has an effect only on removal of noise at a specific frequency band, such that there is a limit in removing well the noise generated at the intake system of a vehicle engine.

In contrast, sound intentionally generated at a predetermined frequency band can improve comfort for drivers.

For example, a specific bike includes components and is controlled to generate sound improving riding comfort of a rider by making exhaust sound so that sound at a specific frequency band is output.

Further, for a vehicle too, when a vehicle travels in a sport mode, that is, an operation mode for providing traveling feel like in traveling of a sports vehicle, a technology of controlling the suspension, the shifting way, and output sound is used.

However, the technology of the related art has a problem in that the entire noise level increases, when a sporty tone increases, and the maximum of the sporty tone is limited by the entire noise level.

Further, a common sound generator, which can perform ON/OFF control as position control of a motor, has a problem in that linear tone change is impossible because the position change of a valve to the noise feature change in ON/OFF control is fast.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an active control sound generator having advantages of being able to perform active control because it can perform control for each of driving conditions without a specific device, and having improved sealing performance.

In an aspect of the present invention, an active control sound generator apparatus may include a housing disposed at an end of an intake duct in a vehicle, having an intake port at an end, and having a driving unit case thereon, a control actuator disposed at a side in the driving unit case, a valve plate disposed in the intake port and connected to a rotary shaft, wherein the valve plate selectively opens or closes the intake port, a control unit including a position sensing wheel disposed at an end of the rotary shaft of the valve plate, in the driving unit case to measure a rotation amount of the valve plate, and a driving gear assembly engaged with the valve plate and the rotary shaft, in the driving unit case, and reducing and transmitting torque of the control actuator to the rotary shaft.

The control actuator is a servo motor of which the number of revolutions and rotation direction is controlled.

The valve plate may include a disc, and a sealing pad mounted on an edge of the disc.

The disc is made of plastic and the sealing pad is made of rubber.

The valve plate is formed by double injection molding of the disc and the sealing pad on the edge of the disc.

The disc may include a plurality of protrusions integrally protruding along the edge of the disc such that fastening force between the disc and the sealing pad of the valve plate is ensured by the protrusions.

The drive gear assembly may include a driving gear fixed to a driving shaft of the control actuator, a worm wheel fixed to the rotary shaft of the valve plate, a horizontal shaft disposed between the driving gear and the worm wheel in the driving unit case, and supported by the driving unit case, a driven gear fixed to the horizontal shaft and engaged with the driving gear, and a worm connected with the driven gear by a connecting portion, on the horizontal shaft, and engaged with the worm wheel.

An exemplary embodiment of the present invention can perform active control because the driving gear assembly is connected with the control motor and control for each of operations is possible by the control unit recognizing APS and RPM signals.

Further, since the valve plate is manufactured by double injection molding, rigidity and sealing performance are improved.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
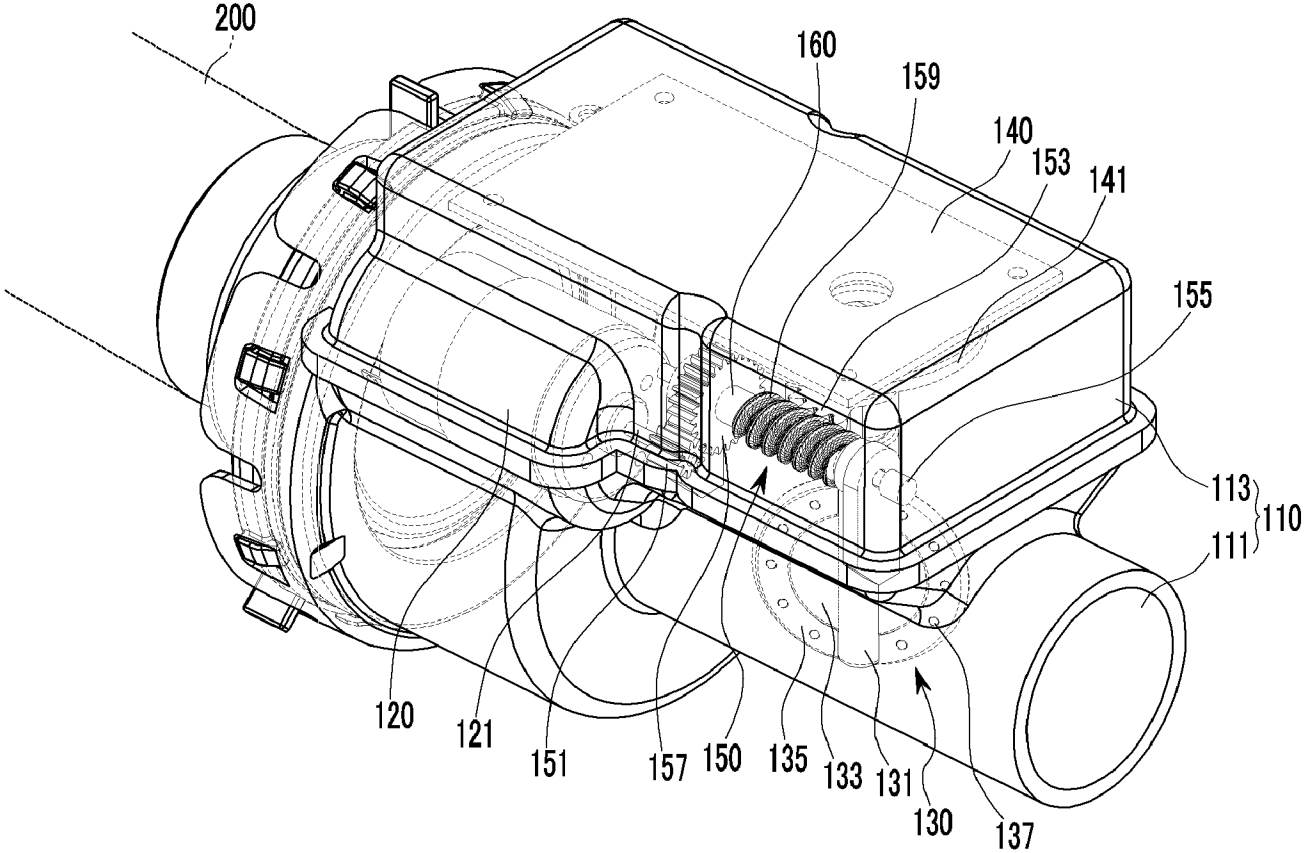
FIG. 1 is a perspective view of an active control sound generator according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Exemplary embodiments of the present invention will be described hereinafter in detail with reference to the accompanying drawings.

The sizes and thicknesses of the configurations shown in the drawings are provided selectively for the convenience of description, such that the present invention is not limited to those shown in the drawings and the thicknesses are exaggerated to make some parts and regions clear.

Further, parts that are not related to the description are not drawn to make exemplary embodiments of the present invention clear.

Figure 2:
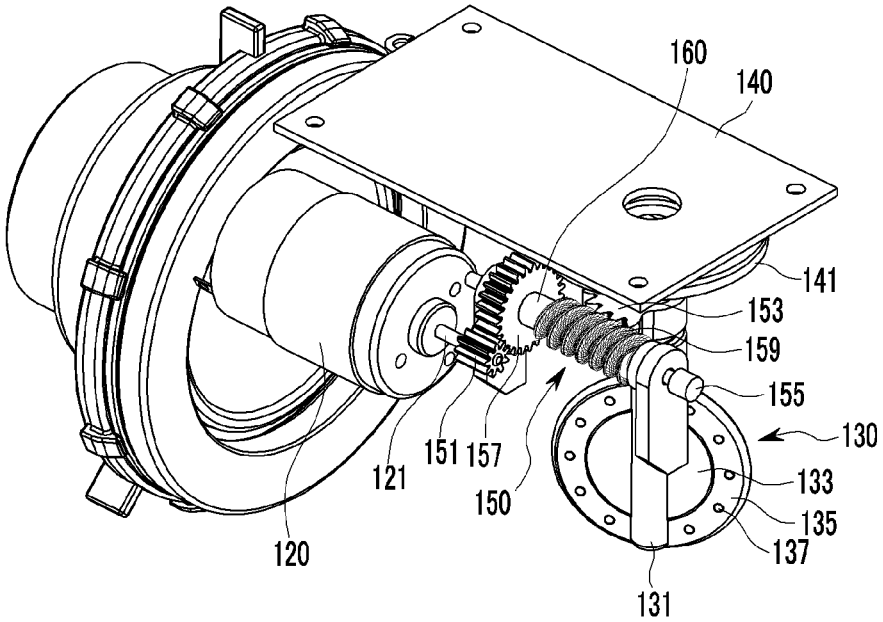
FIG. 2 is a perspective view showing the internal configuration of the active control sound generator according to an exemplary embodiment of the present invention.
Figure 3:
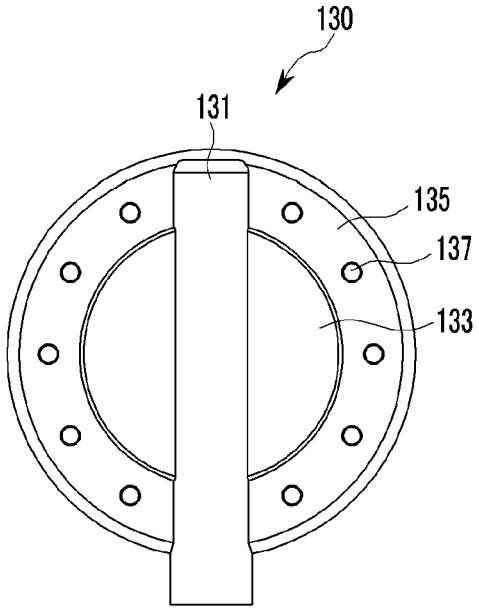
FIG. 3 is a front view of a valve plate used in the active control sound generator according to an exemplary embodiment of the present invention.
Figure 4:
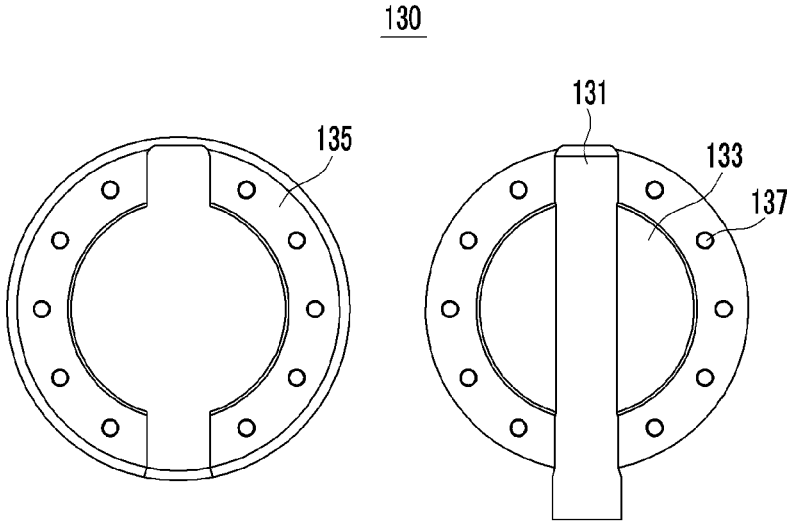
FIG. 4 is a front view of the valve plate of FIG. 3 which is disassembled.

FIG. 1 is a perspective view of an active control sound generator according to an exemplary embodiment of the present invention, FIG. 2 is a perspective view showing the internal configuration of the active control sound generator according to an exemplary embodiment of the present invention, FIG. 3 is a front view of a valve plate used in the active control sound generator according to an exemplary embodiment of the present invention, and FIG. 4 is a front view of the valve plate of FIG. 3 which is disassembled.

Referring to FIGS. 1 to 4, an active control sound generator 100 according to an exemplary embodiment of the present invention includes a housing 110, a control motor 120, a valve plate 130, a control unit 140, and a driving gear assembly 150.

The housing 110 is disposed at an end of an intake duct 200 and has an intake port 111 at an end. A driving unit case 113 is disposed on the housing 110.

The control motor 120 is disposed at a side in the driving unit case 113 and may be implemented by a servo motor of which the number of revolutions and the rotation direction can be controlled.

The valve plate 130 is disposed at the intake port 111 by a rotary shaft 131.

The valve plate 130 includes a disc 133 made of plastic and a sealing pad 135 made of rubber on the edge of the disc 133.

The valve plate 130 is formed by double injection molding of the disc 133 and the sealing pad 135 on the edge of the disc 133.

In the valve plate 130, the fastening force between the disc 133 and the sealing pad 135 is ensured by a plurality of protrusions 137 integrally protruding along the edge of the disc 133.

The control unit 130 is disposed in the driving unit case 113 and includes a position sensing wheel 141 disposed at the end of the rotary shaft 131 of the valve plate 130.

The driving gear assembly 150 is disposed between the control motor 120 and the rotary shaft 131 of the valve plate 130, in the driving unit case 113, and reduces and transmits revolution of the control motor 120 to the rotary shaft 131.

The driving gear assembly 150 includes a driving gear 151, a worm wheel 153, a horizontal shaft 155, a driven gear 157, and a worm 159.

The driving gear 151 is fitted on the driving shaft 121 of the control motor 120 and the worm wheel 153 is fitted on the rotary shaft 131 of the valve plate 130.

The horizontal shaft 155 is disposed between the driving gear 151 and the worm wheel 153 and supported by the driving unit case 113.

The driven gear 157 is rotatably mounted on the horizontal shaft 155 and engaged with the driving gear 151.

The worm 159 is connected with the driven gear 157 by a connection portion 160, on the horizontal shaft 155, and engaged with the worm wheel 153.

In the active control sound generator 100 having the configuration described above, a plurality of control maps is stored in the control unit 140 and the operation can be controlled in accordance with the control map selected on the basis of the tone selected by a user. That is, the opening angle of the valve plate according to the RPM of the engine is stored in the control map selected by the user and the control unit 140 controls the opening angle of the valve plate 130 by driving the control motor 120 on the basis of a signal from an integral magnetic sensor on the rotary shaft 131 of the valve plate 130.

The opening angle of the valve plate 130 according to APS and RPM etc. may be stored in the maps stored in the control unit 140 and the opening angle of the valve plate 130 may be set in advance through a test.

The active control sound generator 100 having the configuration can change the position of the valve plate 130 almost linearly close to a line in accordance with RPM.

The valve plate 130 formed by double injection molding of the plastic disc and the rubber sealing pad can ensure sealing performance against lines in the close status.

Further, the active control sound generator 100 according to an exemplary embodiment of the present invention can perform active control because the driving gear assembly 150 is connected with the control motor 120 and control for each of operations is possible by operating the control unit 140 recognizing APS and RPM signals.

Further, since the valve plate 130 is manufactured by double injection molding, rigidity and sealing performance are improved.

For convenience in explanation and accurate definition in the appended claims, the terms "upper", "lower", "inner" and "outer", are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof.

It is intended that the scope of the invention be defined by the Claims appended hereto and their equivalents.

What is claimed is:

1. An active control sound generator apparatus comprising:

a housing disposed at an end of an intake duct in a vehicle, having an intake port at an end, and having a driving unit case thereon;

a control actuator disposed at a side in the driving unit case;

a valve plate disposed in the intake port and connected to a rotary shaft, wherein the valve plate selectively opens or closes the intake port;

a control unit including a position sensing wheel disposed at an end of the rotary shaft of the valve plate, in the driving unit case to measure a rotation amount of the valve plate; and a driving gear assembly engaged with the valve plate and the rotary shaft, in the driving unit case, and reducing and transmitting torque of the control actuator to the rotary shaft.

2. The generator apparatus of claim 1, wherein the control actuator is a servo motor of which the number of revolutions and rotation direction is controlled.

3. The generator apparatus of claim 1, wherein the valve plate includes:

a disc; and a sealing pad mounted on an edge of the disc.

4. The generator apparatus of claim 3, wherein the disc is made of plastic and the sealing pad is made of rubber.

5. The generator apparatus of claim 3, wherein the valve plate is formed by double injection molding of the disc and the sealing pad on the edge of the disc.

6. The generator apparatus of claim 3, wherein the disc includes a plurality of protrusions integrally protruding along the edge of the disc such that fastening force between the disc and the sealing pad of the valve plate is ensured by the protrusions.

7. The generator apparatus of claim 1, wherein the drive gear assembly includes:

a driving gear fixed to a driving shaft of the control actuator;

a worm wheel fixed to the rotary shaft of the valve plate;

a horizontal shaft disposed between the driving gear and the worm wheel in the driving unit case, and supported by the driving unit case;

a driven gear fixed to the horizontal shaft and engaged with the driving gear; and a worm connected with the driven gear by a connecting portion, on the horizontal shaft, and engaged with the worm wheel.

* * * * *